US010004276B2

(12) United States Patent
Niedens

(10) Patent No.: US 10,004,276 B2
(45) Date of Patent: Jun. 26, 2018

(54) RETAINABLE COLLAR STAY

(71) Applicant: Jeffrey G. Niedens, Peoria, IL (US)

(72) Inventor: Jeffrey G. Niedens, Peoria, IL (US)

(73) Assignee: Jeffrey G Niedens, Peoria, IL (US)

( * ) Notice: Subject to any disclaimer, the term of this patent is extended or adjusted under 35 U.S.C. 154(b) by 230 days.

(21) Appl. No.: 15/130,968

(22) Filed: Apr. 16, 2016

(65) Prior Publication Data

US 2016/0302490 A1 Oct. 20, 2016

Related U.S. Application Data

(60) Provisional application No. 62/149,048, filed on Apr. 17, 2015.

(51) Int. Cl.
*A41B 3/06* (2006.01)

(52) U.S. Cl.
CPC ..... *A41B 3/06* (2013.01)

(58) Field of Classification Search
CPC ..... A41B 3/06; A41D 27/00
USPC ..... 2/129, 255–260, 260.1
See application file for complete search history.

(56) References Cited

U.S. PATENT DOCUMENTS

| | | | | | |
|---|---|---|---|---|---|
| 2,654,889 | A * | 10/1953 | Doric | A41B 3/06 | 2/132 |
| 3,132,347 | A * | 5/1964 | Light | A41B 3/06 | 2/132 |
| 3,531,807 | A * | 10/1970 | Devito | A41D 27/06 | 2/256 |
| 3,842,435 | A * | 10/1974 | Williams | A41B 3/00 | 2/132 |
| 6,202,221 | B1 * | 3/2001 | Ackley, Jr. | A41C 1/14 | 2/255 |
| 2009/0038049 | A1 * | 2/2009 | West | A41B 3/06 | 2/132 |

* cited by examiner

*Primary Examiner* — Katherine Moran

(57) ABSTRACT

A retainable collar stay for a shirt includes an elongated body, at least one resilient member, and at least one barb. The elongated body includes a first side and a second side. The at least one resilient member is fixedly connected to one of the first side and the second side. The at least one barb is fixedly connected to one of the first side and the second side.

20 Claims, 13 Drawing Sheets

RETAINABLE COLLAR STAY

PRIORITY

This application claims priority to and incorporates by reference in its' entirety, U.S. Provisional Patent Application No. 62/149,048, entitled "Retainable Collar Stay", and filed Apr. 17, 2014.

TECHNICAL FIELD

The present invention generally pertains to clothing and apparel. More particularly, the present invention pertains to collar stays for shirts.

BACKGROUND OF THE INVENTION

Collar stays are shirt accessories which may stabilize collar points on the collar of a shirt, and ensure the collar retains its' shape. Collar stays may also ensure that the collar remains in the right place. Traditionally, collar stays have been smooth rigid strips of plastic, but can also be made of any other rigid material such as aluminum, brass, stainless steel, silver, horn, baleen, mother of pearl, or any other rigid material which may be inserted into specially made pockets on the underside of a shirt collar. If the collar stays are not removed prior to washing or dry cleaning, it is common for them to slide out of the collar pocket and be misplaced or lost.

Stays which are designed to be easily removed may come loose while wearing and slip out of the pocket. Some manufacturers have sewn stays into shirt collars to ensure that the stay remains in the pocket. However, these stays may cause damage to the shirt. In addition, if the stay loses its shape due to damage, there is no method to repair or to replace the collar stay.

Different shirts may have different size collars, which require different size stays. Several sizes of stays may need to be purchased to satisfy one person's need for all their shirts.

The disclosed collar stays may solve the above or other problems.

SUMMARY OF THE INVENTION

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

In one aspect of the present invention, a retainable collar stay for a shirt includes an elongated body, at least one resilient member, and at least one barb. The elongated body includes a first side and a second side. The at least one resilient member is fixedly connected to one of the first side and the second side. The at least one barb is fixedly connected to one of the first side and the second side.

In another aspect of the present invention, a retainable collar stay for a shirt includes an elongated body and at least one resilient member. The elongated body includes a first side, a second side, and an insertion end. The insertion end is tapered. The at least one resilient member is fixedly connected to one of the first side and the second side.

In yet another aspect of the present invention, a retainable collar stay for a shirt includes an elongated body and at least one barb. The elongated body includes a first side, a second side, and an insertion end. The insertion end is tapered. The at least one barb is fixedly connected to one of the first side and the second side.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

Figure 1B:
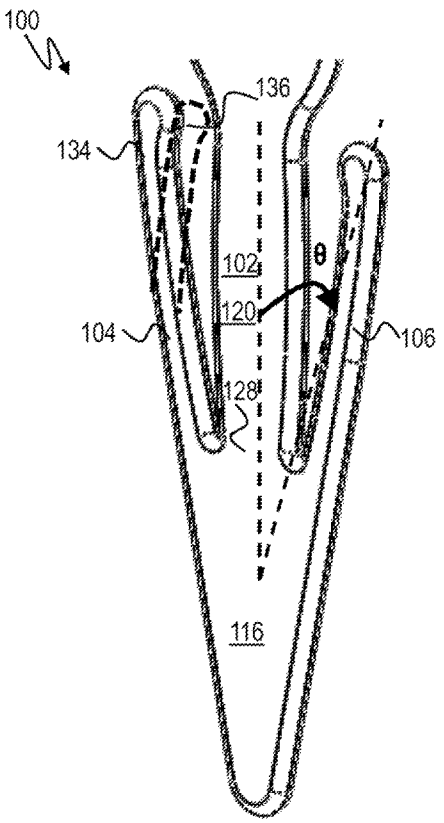
FIG. 1B is an enlarged perspective view of the section of the collar stay labeled 1B in FIG. 1A.
Figure 1A:
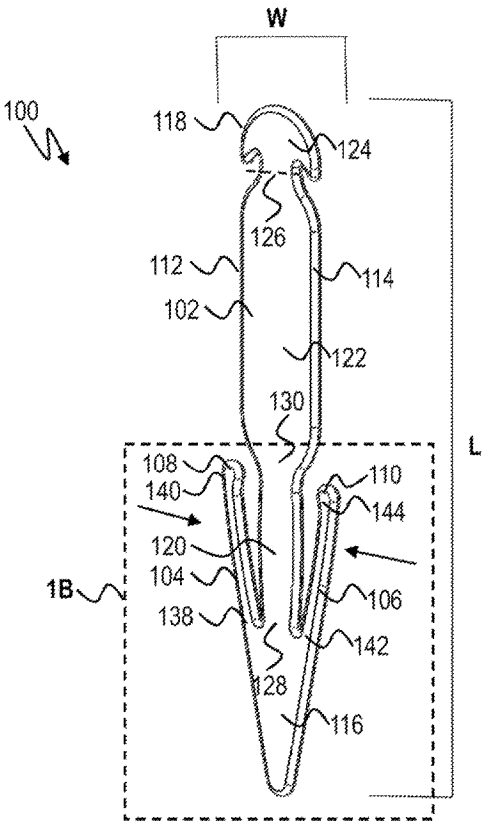
FIG. 1A is a perspective view of a first embodiment of a collar stay according to an exemplary embodiment of the present invention.

Referring now to FIGS. 1A and 1B, a first embodiment of an exemplary retainable collar stay 100 is illustrated in a perspective and enlarged view. The stay 100 includes an elongated body 102, at least one resilient member 104, 106, and at least one barb 108, 110. The body 102 includes a first side 112 and a second side 114. The at least one resilient member 104, 106 is fixedly connected to one of the first side 112 and the second side 114. The at least one barb 108, 110 is fixedly connected to one of the first side 112 and the second side 114. The stay 102 may be generally flat and have a length L, and a width W. The stay 100 may be made of a flexible and resilient material such as plastic or metal, or a composite of plastic and/or metal. The stay 100 may be made of a material which may go through a washing machine and dryer in a stay pocket 204 (shown and described in relation to FIGS. 19-23) of a shirt 200 (shown and described in relation to FIGS. 19-23) and not damage or discolor the shirt 200. Alternatively, the stay 100 may be coated with a material which will prevent the stay 100 from damaging or discoloring the shirt 200. The stay 100 may be cut from a sheet of material, molded, produced with a three dimensional (3D) printer, or manufactured in anyway which would be known to an ordinary person skilled in the art.

Figure 2B:
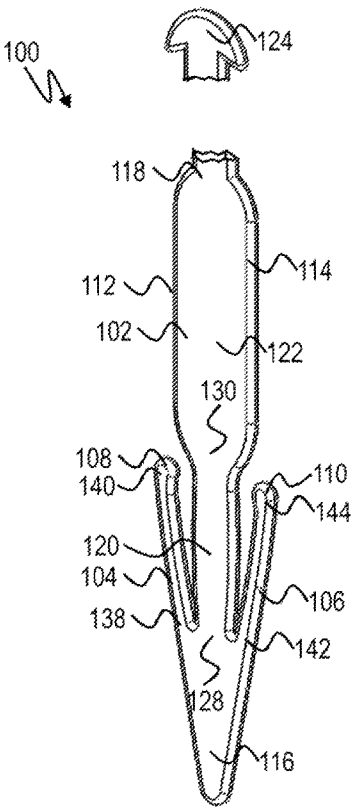
FIG. 2B is a perspective view of the collar stay of FIG. 2A with the detachable tab detached.
Figure 2A:
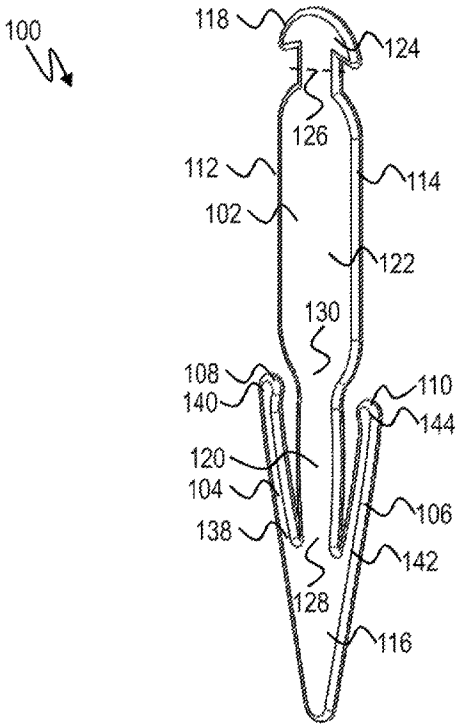
FIG. 2A is a perspective view of a second embodiment of a collar stay with a detachable tab according to an exemplary embodiment of the present invention.

The body 102 may include an insertion section 116, with an insertion end 117*a* flexing section 120, a main section 122, and a detachable break-off tab 124. The insertion end 116 may be tapered to allow easy insertion into the stay pocket 204 of the shirt 200. The insertion end 116 may be fixedly and integrally connected to the flexing section 120 at a first intersection 128. The flexing section 120 may be fixedly and integrally connected to the main section 122 at a second intersection 130. The main section 122 may be fixedly, integrally, and detachably connected to the break-off tab 124 at a breaking line 126. The body 102 may include a retraction end 118. The break-off tab 124 may include the retraction end 118 when the break-off tab 124 is fixedly connected to the main section 122. But, when the break-off tab 124 is detached from the main section 122, the main section 122 may include the retraction end 118 (as shown in FIGS. 2A and 2B).

Moving along the length of the body 102 in a direction from the insertion end 116 to the retraction end 118, the width of the body 102 may increase from a pointed end to the first intersection 128. The width of the body 102 may decrease at the first intersection 128 and may then increase at the second intersection 130. The width of the body 102 may decrease moving towards the breaking line 126, and then increase moving towards the break-off tab 124.

A first resilient member 104 may extend out from the body 102 on the first side 112 at the first intersection 128. The first resilient member 104 may be an elongated member and include a first end 138 and a second end 140. The first end 138 may be fixedly attached to the body 102 at the first intersection 128. The second end 140 may be fixedly attached to a first barb 108. A second resilient member 106 may extend out from the body 102 on the second side 114 at the first intersection 128. The second resilient member 104 may be an elongated member and include a first end 142 and a second end 144. The first end 142 may be fixedly attached to the body 102 at the first intersection 128. The second end 144 may be fixedly attached to a second barb 110.

As seen best in FIG. 1B, the first and second resilient members 104, 106 may have a first, at rest position 134, and a second flexed position 136. When in the first, at rest position 134 the first and second resilient members 104, 106 may extend from the body 102 at an angle θ. When the stay 100 is inserted into the stay pocket 204, the resilient members 104, 106 may be flexed inward towards the flexing section 120 of the body 102 by pressure from sides 208 (shown and described in relation to FIGS. 19-23) of the pocket 200. This pressure may be in the direction of the arrows in FIG. 1A. The barbs 108, 110, and outward pressure from the resilient members 104, 106 against the sides of the pocket 204, may prevent the stay 100 from falling out of the pocket 200.

Referring now to FIGS. 2A and 2B, an exemplary second embodiment of the collar stay 100 is illustrated is perspective view. The second embodiment of the stay 100 is similar to the first embodiment, but includes a different second style of the break-off tab 124. FIG. 2A illustrates the stay 100 with the break-off tab 124 attached, and FIG. 2B illustrates the stay 100 with the break-off tab 124 detached.

Figure 3:
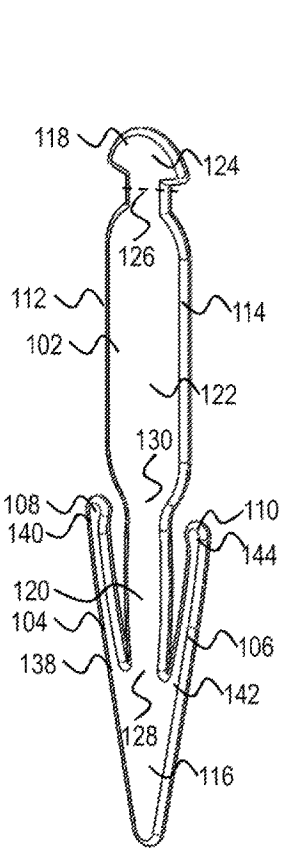
FIG. 3 is a perspective view of a third embodiment of a collar stay according to an exemplary embodiment of the present invention.

Referring now to FIG. 3, an exemplary third embodiment of the stay 100 is illustrated in perspective view. The third embodiment of the stay 100 is similar to the first and second embodiments, but includes a different third style of the break-off tab 124.

Figure 4B:
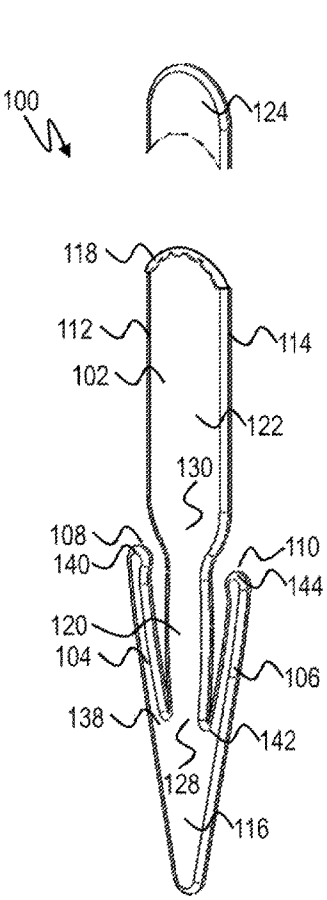
FIG. 4B is a perspective view of the collar stay of FIG. 4A with the detachable tab detached.
Figure 4A:
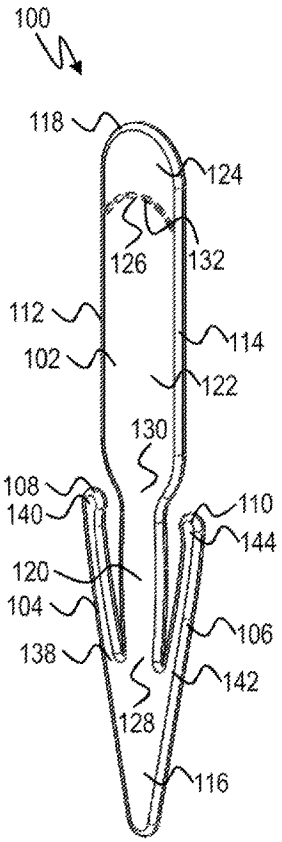
FIG. 4A is a perspective view of a fourth embodiment of a collar stay with a detachable tab according to an exemplary embodiment of the present invention.

Referring now to FIGS. 4A and 4B, an exemplary fourth embodiment of the collar stay 100 is illustrated in perspective view. The fourth embodiment of the stay 100 is similar to the first through third embodiments, but includes a different fourth style of the break-off tab 124, and a different main section 122 to break-off tab 124 fixed connection. In the fourth embodiment of the stay 100 the width of the body 102 does not decrease moving in the direction from the main section 122 to the breaking line 126, and does not increase going in the direction from the breaking line 126 to the break-off tab 124. The breaking line 126 includes perforations 132 to aid in detaching the break-off tab 124 from the stay 100. FIG. 4A illustrates the stay 100 with the break-off tab 124 attached, and FIG. 4B illustrates the stay 100 with the break-off tab 124 detached.

Figure 5B:
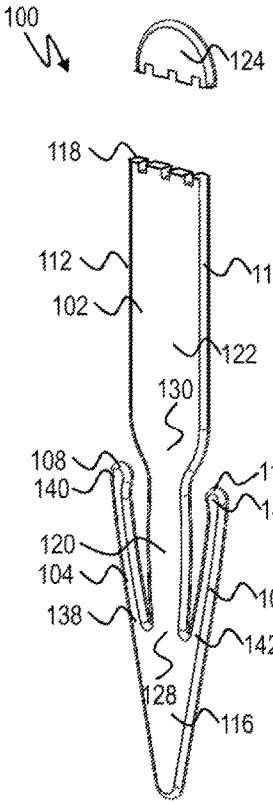
FIG. 5B is a perspective view of the collar stay of FIG. 5A with the detachable tab detached.
Figure 5A:
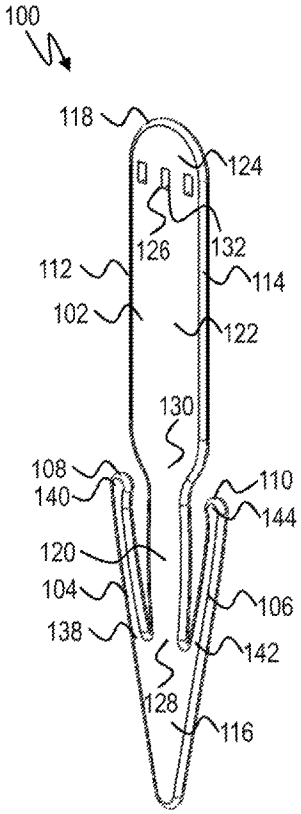
FIG. 5A is a perspective view of a fifth embodiment of a collar stay with a detachable tab according to an exemplary embodiment of the present invention.
Figure 9:
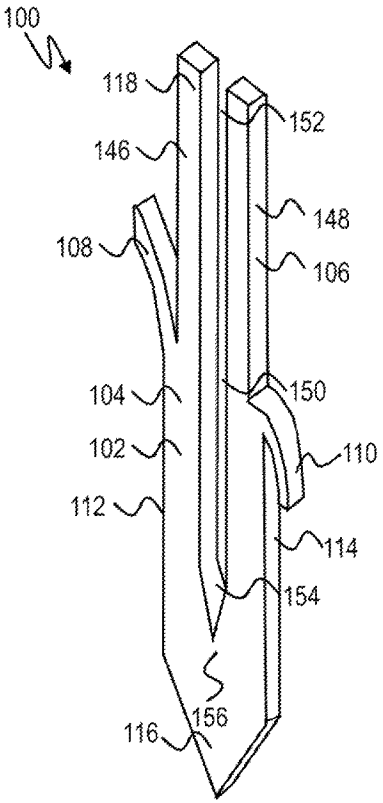
FIG. 9 is a perspective view of a ninth embodiment of a collar stay according to an exemplary embodiment of the present invention.
Figure 8:
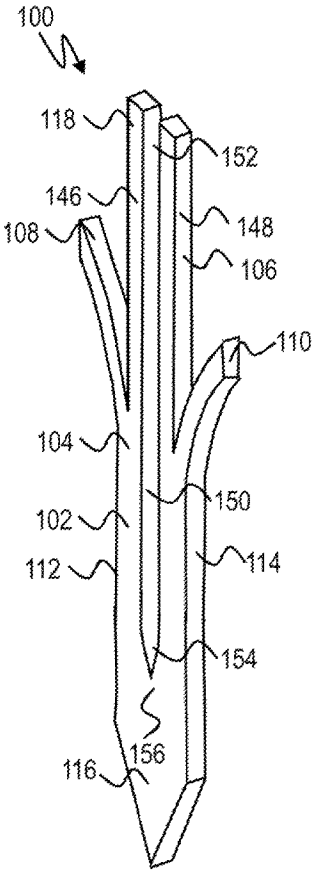
FIG. 8 is a perspective view of an eighth embodiment of a collar stay according to an exemplary embodiment of the present invention.

Referring now to FIGS. 5A and 5B, an exemplary fifth embodiment of the collar stay 100 is illustrated in perspective view. The fifth embodiment of the stay 100 is similar to the fourth embodiment, but the perforations 132 are a different second style with a different shape and configuration than illustrated in FIGS. 4A and 4B. FIG. 5A illustrates the stay 100 with the break-off tab 124 attached, and FIG. 5B illustrates the stay 100 with the break-off tab 124 detached.

Figure 6:
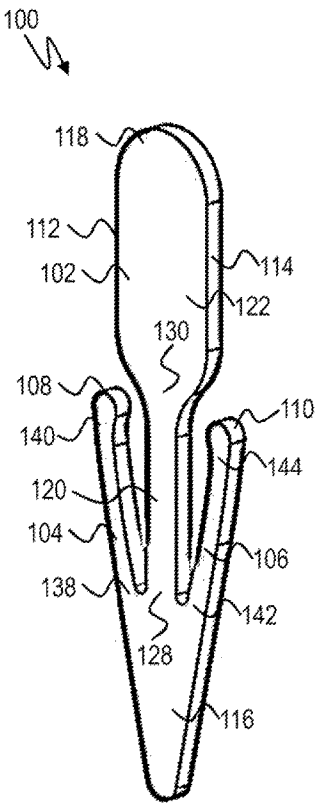
FIG. 6 is a perspective view of a sixth embodiment of a collar stay according to an exemplary embodiment of the present invention.

Referring now to FIG. 6, an exemplary sixth embodiment of the stay 100 is illustrated in perspective view. The sixth embodiment of the stay 100 is similar to the first through fifth embodiments, but does not include a break-off tab 124 or breaking line 126. The retraction end 118 is included in the main section 122.

Figure 7:
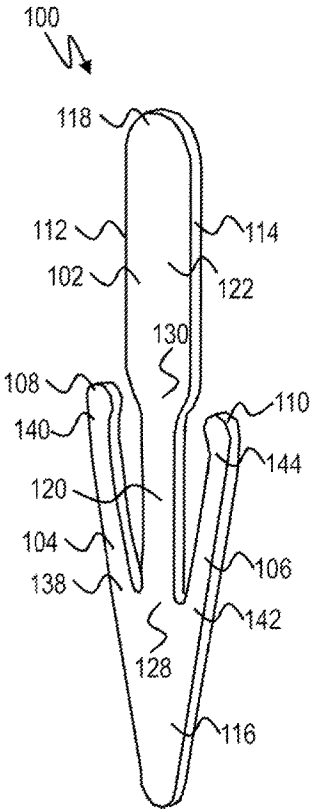
FIG. 7 is a perspective view of a seventh embodiment of a collar stay according to an exemplary embodiment of the present invention.
Figure 12:
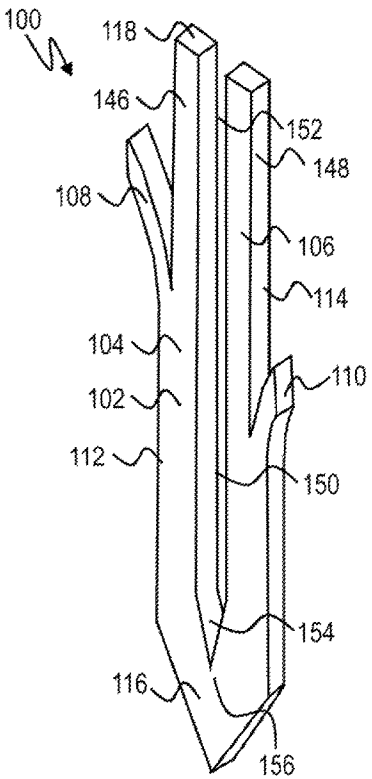
FIG. 12 is a perspective view of a twelfth embodiment of a collar stay according to an exemplary embodiment of the present invention.

Referring now to FIG. 7, an exemplary seventh embodiment of the stay 100 is illustrated in perspective view. The seventh embodiment of the stay 100 is similar to the sixth embodiment, but includes a longer main section 122. The seventh embodiment of the stay 100 may be designed for use in the shirt 200 with a longer stay pocket 204 than the sixth embodiment of the stay 100 is designed for.

Figure 10:
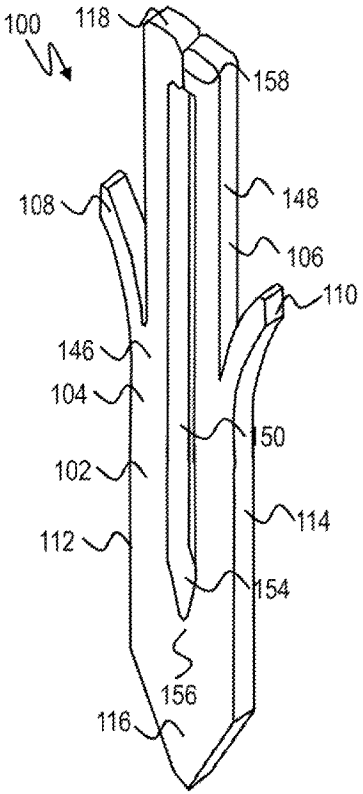
FIG. 10 is a perspective view of a tenth embodiment of a collar stay according to an exemplary embodiment of the present invention.
Figure 15:
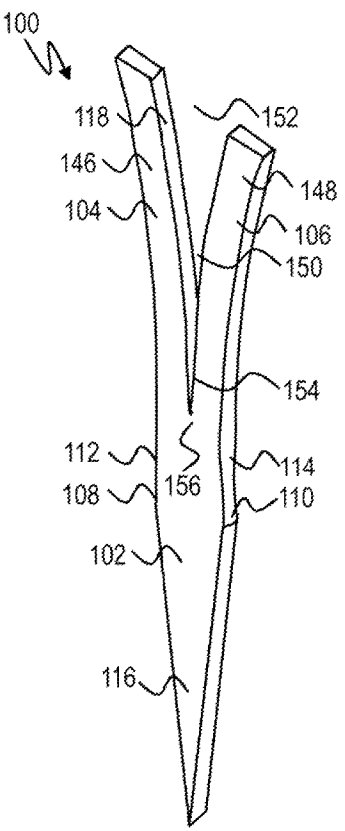
FIG. 15 is a perspective view of a fifteenth embodiment of a collar stay according to an exemplary embodiment of the present invention.
Figure 14:
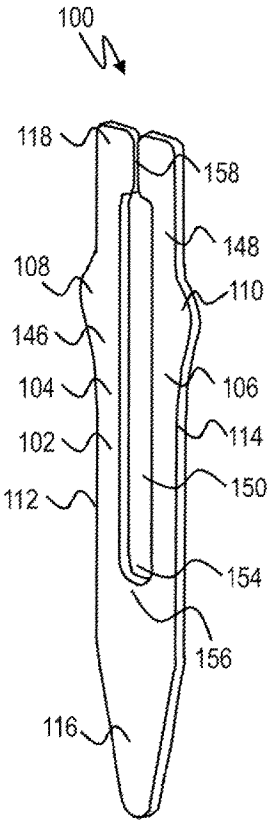
FIG. 14 is a perspective view of a fourteenth embodiment of a collar stay according to an exemplary embodiment of the present invention.
Figure 13:
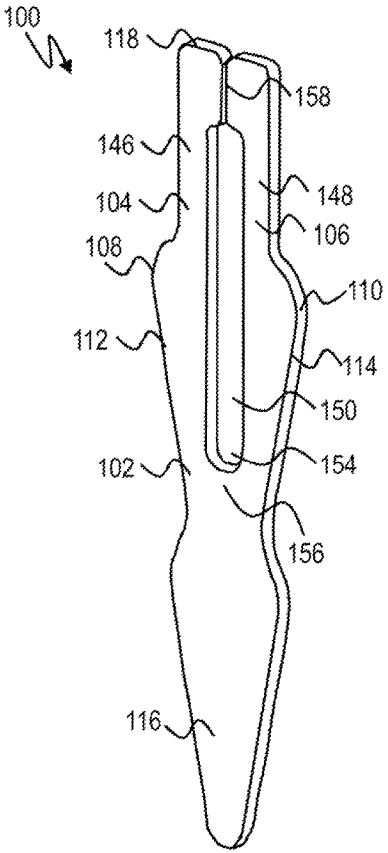
FIG. 13 is a perspective view of a thirteenth embodiment of a collar stay according to an exemplary embodiment of the present invention.

Referring now to FIGS. 8-15, exemplary eighth, ninth, tenth, eleventh, twelfth, thirteenth, fourteenth, and fifteenth embodiments of the stay 100 are illustrated in perspective views. Each of these embodiments includes an elongated body 102 and at least one resilient member 104, 106. The elongated body 102 includes a first side 112, a second side 114, and an insertion end 116. The at least one resilient member 104, 106 is fixedly connected to one of the first side and the second side. The insertion end 116 is tapered. The body 102 may include the insertion end 116 fixedly connected to a first leg 146 at the first side 112, and fixedly connected to a second leg 148 at the second side 114. A channel 150 may be located between the first leg 146 and the second leg 148. The channel 150 may include a channel closed end 154. In FIGS. 8-9, 11-12, and 15, the channel 150 may include an open end 152. In FIGS. 10, and 13-14, the first leg 146 and the second leg 148 may join at a slit 158 at the end of the channel 150 opposite the closed end 154. The insertion end 116, the first leg 146, the second leg 148, and the channel closed end 154 may intersect at a third intersection 156.

Figure 11:
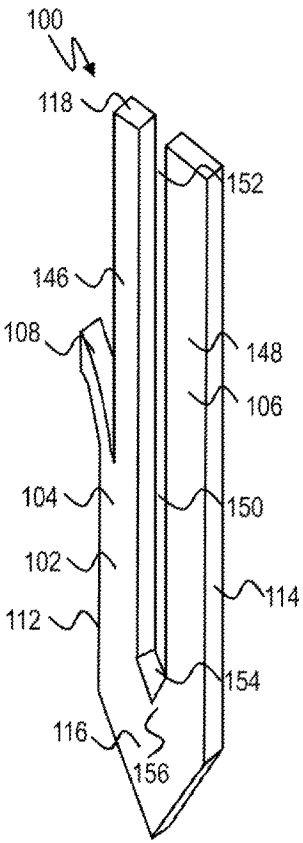
FIG. 11 is a perspective view of an eleventh embodiment of a collar stay according to an exemplary embodiment of the present invention.

The first leg 146 and the second leg 148 may comprise first and second resilient members 104, 106 respectively. In FIGS. 8-10, and 12-15, a first barb 108 is fixedly attached to the first leg 146, and a second barb 110 is fixedly attached to the second leg 148. In FIG. 11 only a first barb 108 is illustrated fixedly connected to the first leg 146. The insertion end 116 may be inserted into the stay pocket 208 and as the stay 100 is pushed into the stay pocket 204, pressure from the sides 208 may push the first leg 146 and the second leg 148 together allowing the stay 100 to be fully inserted. After insertion, the barbs 108, 110 may prevent the stay 100 from falling out of the stay pocket 204.

Figure 16:
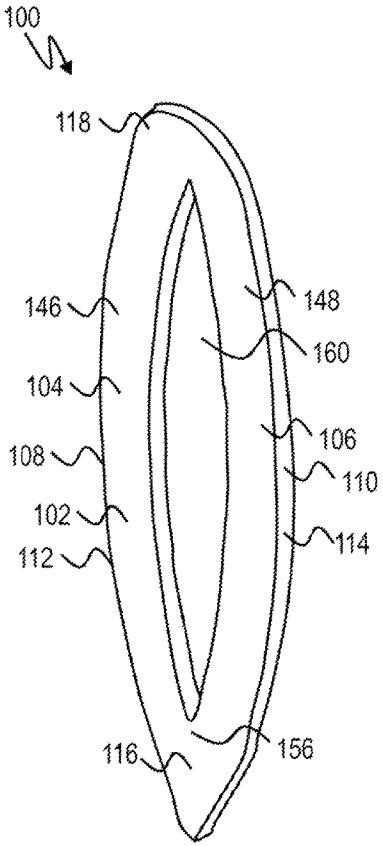
FIG. 16 is a perspective view of a sixteenth embodiment of a collar stay according to an exemplary embodiment of the present invention.

Referring now to FIG. 16, an exemplary sixteenth embodiment of the stay 100 is illustrated in perspective view. In this embodiment, the body 102 may include the insertion end 116, the first leg 146 and the second leg 148. The first leg 146 and the second leg 148 may be elongated arced members joined together at both ends. At one end the joinder may form the insertion end 116 at the third intersection 156, and at the other end, the joinder may form the retraction end 118. The first leg 146 and the second leg 148 may comprise the first resilient member 104 and the second resilient member 120 respectively. The outermost part of the arced form of the first leg 146 and the second leg 148 may comprise the first barb 108 and the second barb 110. The joinder of the first leg 146 and the second leg 148 may form a center aperture 160 between them. The insertion end 116 may be inserted into the stay pocket 208 and as the stay 100 is pushed into the stay pocket 204, pressure from the sides 208 may push the first leg 146 and the second leg 148 together allowing the stay 100 to be fully inserted, and narrowing the center aperture 160. After insertion, outward pressure from the first leg 146 and the second leg 148 at the barbs 108, 110 may prevent the stay 100 from falling out of the stay pocket 204.

Figure 18:
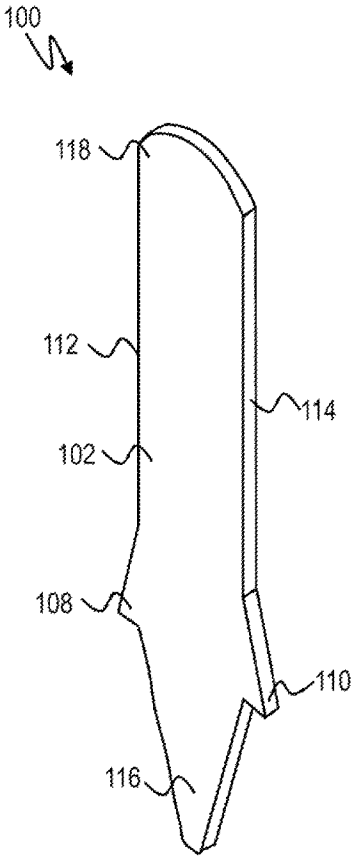
FIG. 18 is a perspective view of an eighteenth embodiment of a collar stay according to an exemplary embodiment of the present invention.
Figure 17:
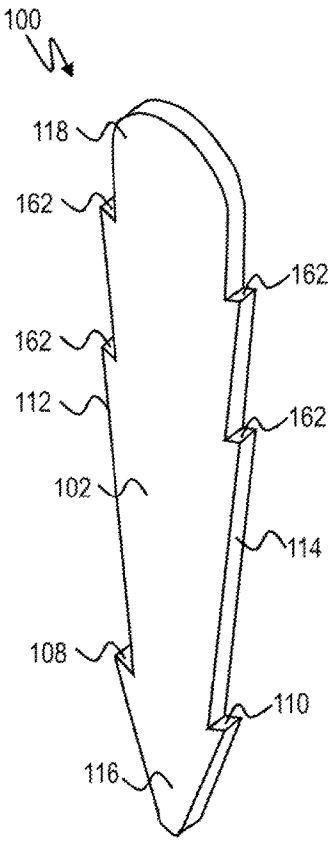
FIG. 17 is a perspective view of a seventeenth embodiment of a collar stay according to an exemplary embodiment of the present invention.

Referring now to FIGS. 17-18, exemplary embodiments of a seventeenth and an eighteenth embodiment of the stay are illustrated in perspective view. The body 102 may include an elongated member with a tapered insertion end 116, a first side 112, a second side 114, and a rounded retraction end 118. The stay 100 may include at least one barb 108, 110, 162 fixedly connected to one of the first side 112 and the second side 114. In both FIGS. 17 and 18, a first barb 108 is fixedly connected to the first side 112, and a second barb 110 is fixedly connected to the second side 114. FIG. 17 illustrates two additional barbs 162 fixedly connected to both the first side 112, and the second side 114. The insertion end 116 may be inserted into the stay pocket 208 and the shape of the body 102 may allow the stay 100 to be fully inserted into the stay pocket 204. After insertion, the barbs 108, 110, 162 may prevent the stay 100 from falling out of the stay pocket 204.

Figure 19:
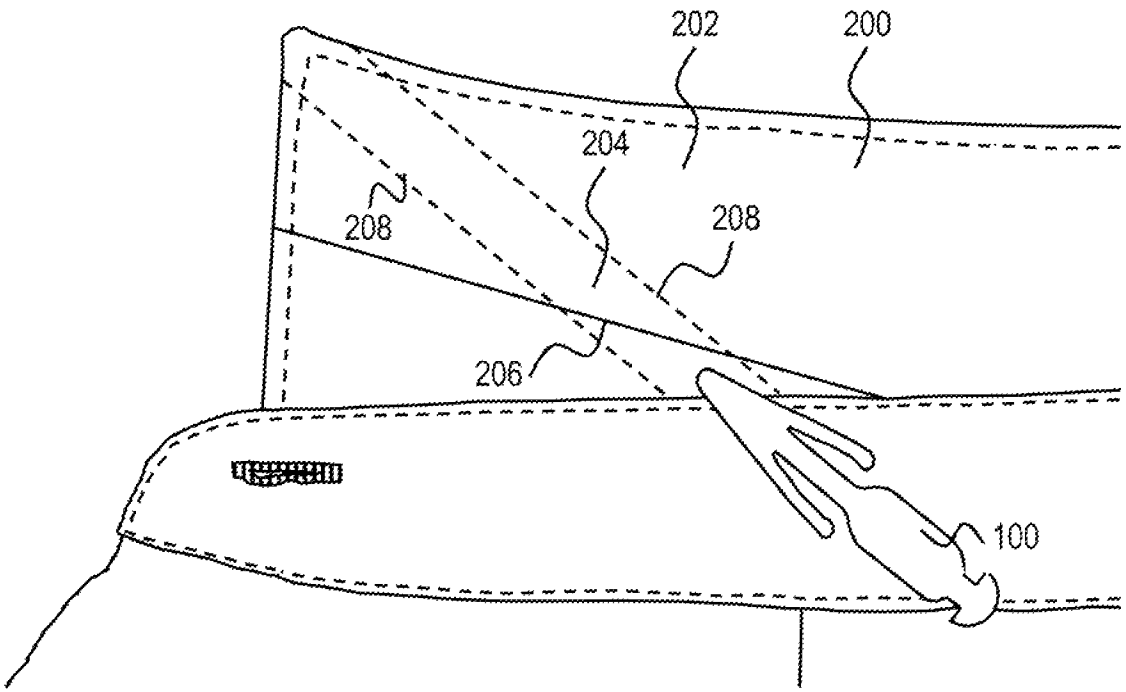
FIG. 19 is a top view of a portion of a shirt with a collar stay pocket and a collar stay in a position to be inserted into the collar stay pocket, according to an exemplary embodiment of the present invention.

Referring now to FIG. 19 a portion of an exemplary shirt 200 with a collar 202 and a collar stay pocket 204, and an exemplary collar stay 100 in a position to be inserted into the collar stay pocket 204 are shown in a top view. The stay pocket 204 may include an opening 206 and sides 208.

Figure 20:
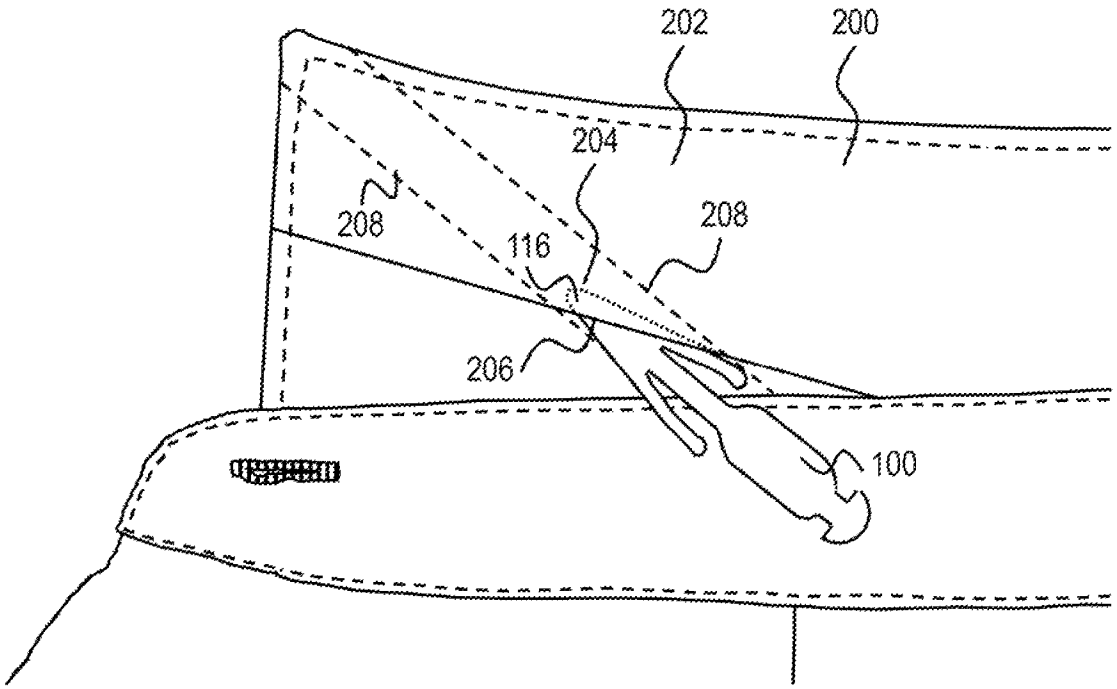
FIG. 20 is a top view of the portion of the shirt and the collar stay of FIG. 19 with the collar stay having a tip of an insertion end inserted into the collar stay pocket, according to an exemplary embodiment of the present invention.

Referring now to FIG. 20, the tip of the insertion end 116 of the stay 100 has been inserted into the pocket 204 through the opening 206. The tapered shape of the insertion end 116 may aid in inserting the stay 100.

Figure 21:
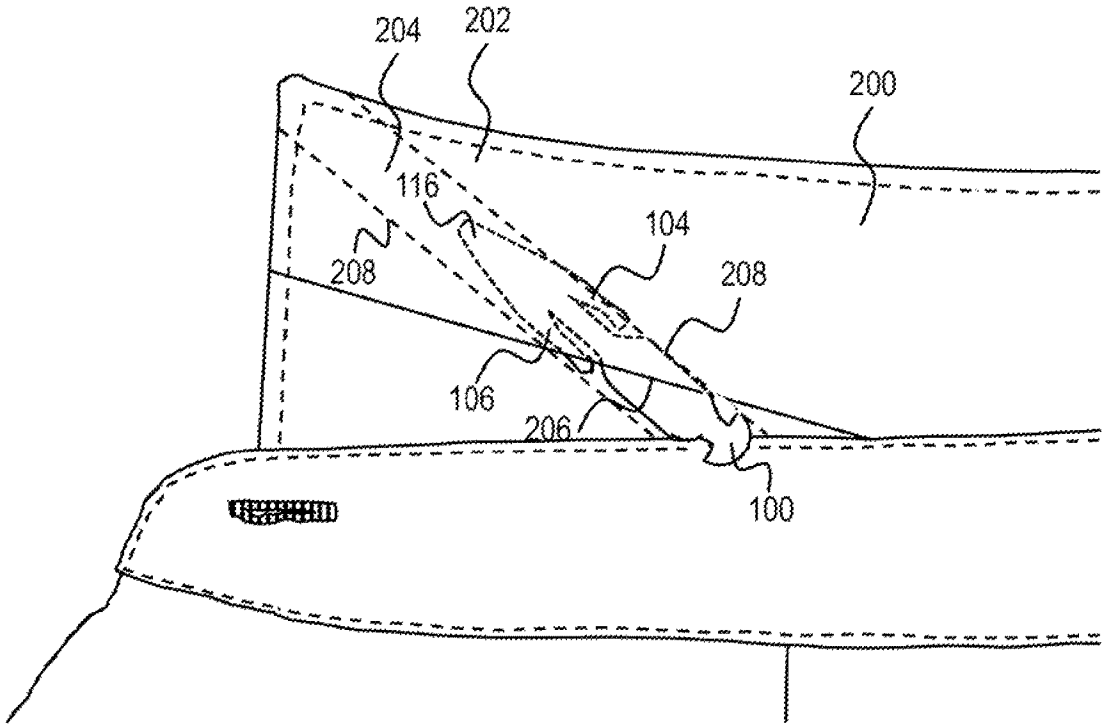
FIG. 21 is a top view of the portion of the shirt and the collar stay of FIG. 19 with the collar stay being about half way inserted into the collar stay pocket, according to an exemplary embodiment of the present invention.

Referring now to FIG. 21, the stay 100 has been inserted about halfway into the pocket 204. The resilient members 104, 106 may be flexed into a second flexed position through pressure from the sides 208 as the stay 100 is pushed into the pocket 204.

Figure 22:
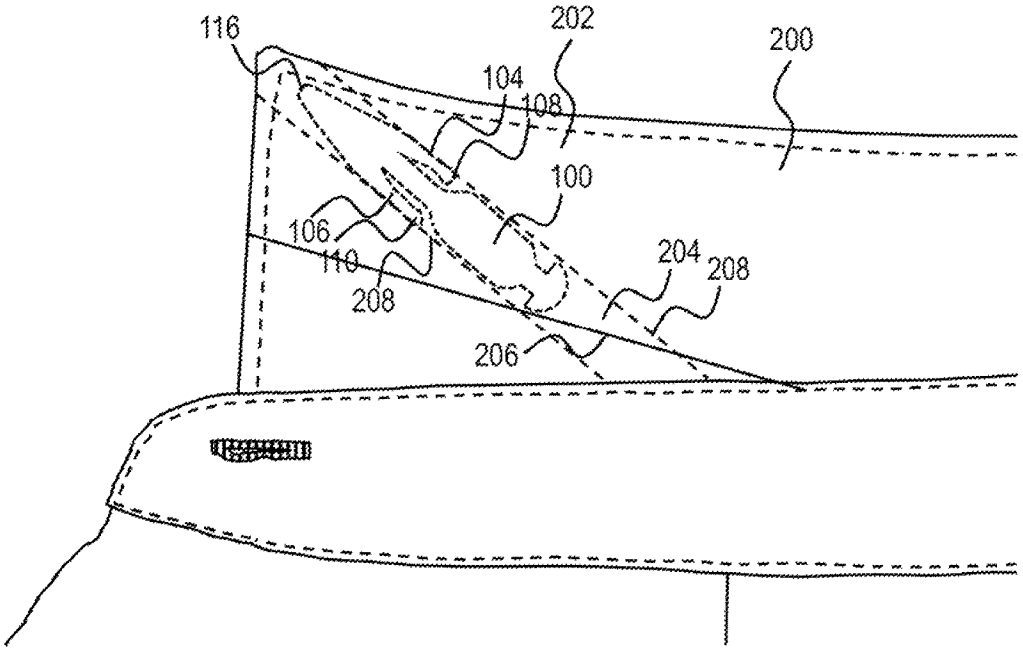
FIG. 22 is a top view of the portion of the shirt and the collar stay of FIG. 19 with the collar stay fully inserted into the collar stay pocket, according to an exemplary embodiment of the present invention.

Referring now to FIG. 22, the stay 100 is fully inserted into the pocket 204. Pressure from the resilient members 104, 106 on the sides, and resistance from the barbs 108, 110 may prevent the stay 100 from falling out of the pocket 204.

Figure 23B:
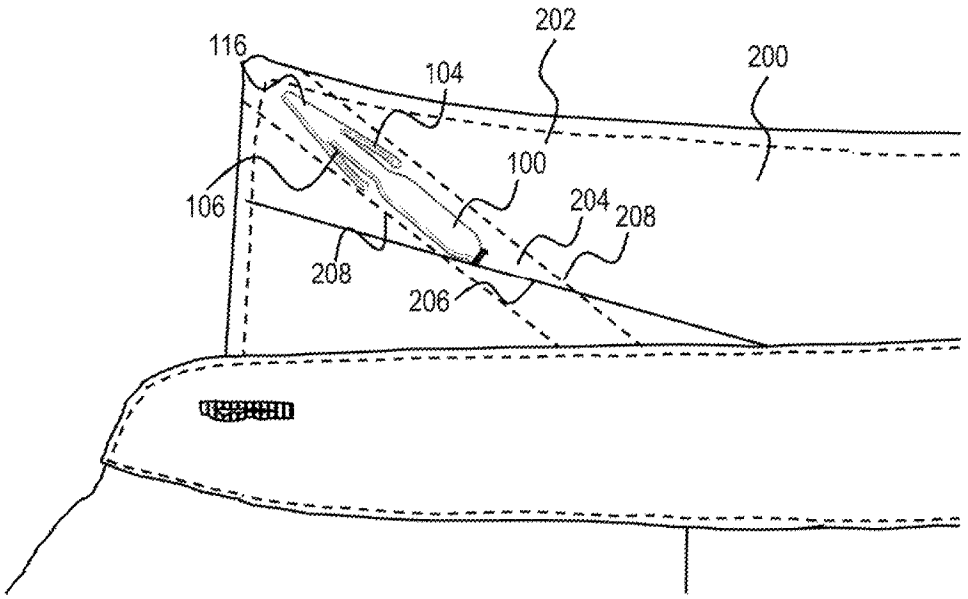
FIG. 23B is a top view of a portion of second embodiment of a shirt with a collar stay pocket and the collar stay of FIG. 23A without the tab fully inserted into the collar stay pocket, according to an exemplary embodiment of the present invention.
Figure 23A:
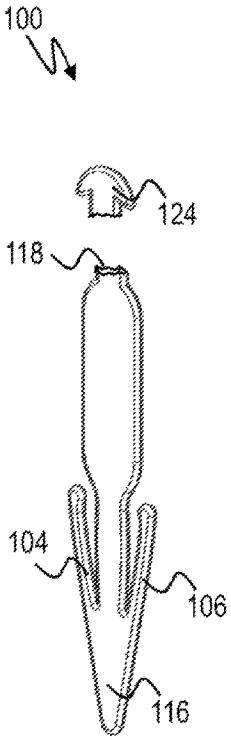
FIG. 23A is a perspective view of the collar stay of FIGS. 2A and 2B with the detachable tab detached, according to an exemplary embodiment of the invention.

Referring now to FIG. 23A, the stay 100 of FIGS. 2A and 2B is illustrated with the detachable tab detached. Some shirts 200 may have smaller collars 202, and a shorter stay 100 may be desired than in larger collar 202 shirts 200.

Multiple stays 100 with detachable tabs 124 may be sold in a package, and the detachable tab 124 may be detached for use with shirts 200 with smaller collars 202.

Referring now to FIG. 23B, the shorter stay 100 (with detachable tab 124 detached) is shown fully inserted in the shorter stay pocket 204.

It should be understood, of course, that the foregoing relates to exemplary embodiments of the invention and that modifications may be made without departing from the spirit and scope of the invention as set forth in the following claims.

I claim:

1. A retainable collar stay for a shirt, comprising:
an elongated body including a first side and a second side;
a first resilient member with an elongated body, a first end, and a second end, the first end fixedly connected to the first side;
a second resilient member with an elongated body, a first end, and a second end, the first end fixedly connected to the second side; and
at least one barb fixedly connected to one of the first side and the second side; and
wherein the second end of the first resilient member and the second end of the second resilient member are configured to flex inward towards the body.

2. The retainable collar stay of claim 1, wherein;
the body includes a flexing section fixedly connected to an insertion end at a first intersection; and
the first end of the first resilient member and the first end of the second resilient member are fixedly connected to the body at the first intersection.

3. The retainable collar stay of claim 2, wherein;
the first resilient member and the second resilient member have an at rest position, and a flexed position;
the first resilient member extends from the body at a first angle when in the at rest position;
the second resilient member extends from the body at a second angle when in the at rest position; and
when the first resilient member and the second resilient member are in the flexed position, the second end of the first resilient member and the second end of the second resilient member flex in towards the body.

4. The retainable collar stay of claim 1, wherein the body includes a tapered insertion end.

5. The retainable collar stay of claim 1, wherein the body is generally flat.

6. The retainable collar stay of claim 1, wherein the collar stay is formed from a flexible plastic.

7. The retainable collar stay of claim 1, wherein the collar stay is formed from sheet metal.

8. The retainable collar stay of claim 1, wherein the stay is cut from a sheet of plastic.

9. The retainable collar stay of claim 1, wherein the stay is molded from plastic.

10. The retainable collar stay of claim 1, wherein the stay is formed with a three dimensional printer.

11. A retainable collar stay for a shirt, comprising:
an elongated body including a first side and a second side;
a first resilient member with an elongated body, a first end, and a second end, the first end fixedly connected to the first side;
a second resilient member with an elongated body, a first end, and a second end, the first end fixedly connected to the second side;
a first barb is fixedly connected to the second end of the first resilient member; and
a second barb fixedly connected to the second end of the second resilient member.

12. The retainable collar stay of claim 11, wherein the body is flat.

13. The retainable collar stay of claim 11, wherein the collar stay is formed from a flexible plastic.

14. A retainable collar stay for a shirt, comprising:
an elongated body including a first side, a second side, and a retraction end, the retraction end including a breaking line and a break-off tab, the break-off tab configured to be broken off the body at the breaking line
at least one resilient member fixedly connected to one of the first side and the second side; and
at least one barb fixedly connected to one of the first side and the second side.

15. The retainable collar stay of claim 14, wherein the body has a lesser width at the breaking line than at the break-off tab.

16. The retainable collar stay of claim 14, wherein the breaking line includes perforations.

17. The retainable collar stay of claim 14, wherein;
the body further includes an insertion end, a flexing section, and a main section; and
the insertion end is fixedly connected to the flexing section at a first intersection, the flexing section is fixedly connected to the main section at a second intersection, and the retraction end is fixedly and detachably connected to the main section at the breaking line.

18. The retainable collar stay of claim 17, wherein;
in a direction moving from the insertion end to the retraction end along a length of the body, the width of the insertion end of the body increases towards the first intersection;
moving in the direction, the width of the body in the flexing section decreases after the first intersection;
moving in the direction from the second intersection, the width of the body in the main section increases;
moving in the direction, the width of the body in the main section decreases towards the breaking line; and
moving in the direction, the width of the body in the break-off tab increases towards the retraction end.

19. The retainable collar stay of claim 14, wherein the collar stay is formed from sheet metal.

20. The retainable collar stay of claim 14, wherein the stay is formed with a three dimensional printer.

* * * * *